United States Patent [19]

McIntosh

[11] Patent Number: 4,901,850

[45] Date of Patent: Feb. 20, 1990

[54] "KOLOR KEEPER" AIR-TIGHT ARTIST'S PALETTE

[76] Inventor: Eual R. McIntosh, Rt. 8, Benton, Ky. 42025

[21] Appl. No.: 340,089

[22] Filed: Apr. 17, 1989

[51] Int. Cl.[4] ..... B65D 81/24

[52] U.S. Cl. ..... 206/205; 206/1.7

[58] Field of Search ..... 206/1.7, 1.8, 1.9, 523, 206/575, 205; 220/378; 312/31.04, 31.1, 31.01

[56] References Cited

U.S. PATENT DOCUMENTS

| | | | |
|---|---|---|---|
| 2,711,605 | 6/1955 | Dripps | 206/1.7 |
| 2,923,081 | 2/1960 | Simmons | 206/1.7 |
| 3,188,036 | 6/1965 | Sprung | 206/1.7 |
| 4,142,627 | 3/1979 | Szegi | 206/1.7 |
| 4,444,306 | 4/1984 | Benaquista | 206/1.7 |
| 4,638,909 | 1/1987 | Ford | 206/1.7 |

*Primary Examiner*—Paul T. Sewell

*Assistant Examiner*—Jacob K. Ackun, Jr.

[57] ABSTRACT

An artists' palette that provides air-tight storage for any painting medium. The air-tight palette includes a tray with multiple individual storage wells. Around each well is a trough depression. A cover that fits over each well is attached to the tray in such a manner as to allow pivotal movement about an axis substantially an arc when the cover is opened and closed. When the trough depression is filled with a liquid compatible with the painting medium and the cover is closed and seated in the trough 100% air-tight storage is possible. A secondary means of air-tight storage is provided by an absorbent element inside each cover. When this absorbent element is moistened and the cover is closed the element seats against the top rim of the well and seals against air. This allows the palette to be used without any liquid in the trough. Air-tight storage is also provided by this secondary method.

5 Claims, 3 Drawing Sheets

"KOLOR KEEPER" AIR-TIGHT ARTIST'S PALETTE

BACKGROUND OF THE INVENTION

1. Field of the Invention

The present invention relates to artists' palettes. In particular, the present invention relates to multiple individual air-tight storage wells constructed on the artists' palette.

2. Description of the prior art

Across the United States and throughout the world artists' palettes are used to gain immediate access to the paint during a work of art.

The characteristics of these palettes are less than ideal. If the painting is not finished within a few hours the exposed paint will dry out. This can result in "down time" for the artist while a new batch of paint is being mixed.

It is undesirable to mix a new batch of paint during a work of art as the hue, intensity, and value of a color are difficult to duplicate. This factor also creates an extra expense because it requires additional paint.

Some present palettes do provide a single cover that does afford some degree of air-tightness. However, their design is such that the cover encloses the entire palette. Once the cover is removed the entire palette and its contents are exposed to the air. Removing and replacing the one cover after each dip of the brush is difficult and time consuming. Should the cover need to be laid aside temporarily more space is required for this purpose. Storage time for paint under these improved conditions is also very limited.

Potential use for an artist's palette that will provide air-tight storage for each individual color is evident.

Reduced paint expenses and "down time" in mixing colors plus improved color harmony are significant.

The air-tight "color saver" palette is extremely easy to operate. The paint is both readily accessible and then re-stored as the air-tight cover of each well easily flips up or down on a pivotal axis. A trough around each well may be filled with liquid thereby creating 100% air-tight storage for the paint. This type artist's palette will play an important role in an artist's career.

SUMMARY OF THE INVENTION

The present invention is an artists' palette which includes multiple color wells. Structural elements are mounted on the palette in such a way as to provide air-tight storage for each individual well. The palette also provides a trough depression around each color well that may be filled with liquid. This liquid acts as a primary seal against air when the cover for the respective well is closed and seated within the trough.

In preferred embodiments, the palette includes a cover for each color well which is pivotally connected for movement about an arc axis while being raised or lowered.

In still other embodiments the air-tight covers include an absorbent element inside each one and the storage means includes multiple color wells. Further air-tight storage means includes troughs around each well which may be filled with liquid compatible with the painting medium.

DETAILED DESCRIPTION OF THE PREFERRED EMBODIMENTS

Figure 1:
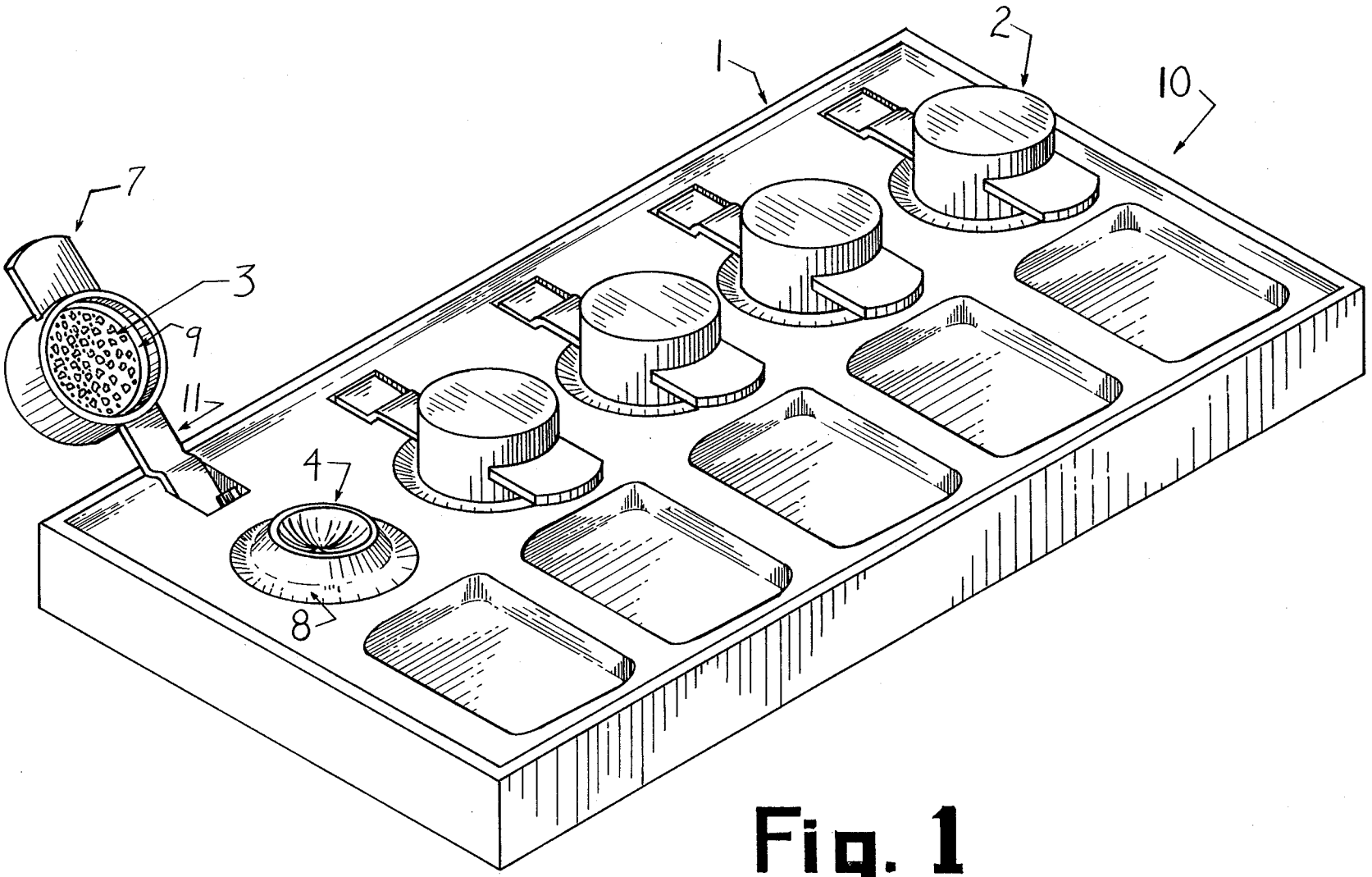
FIG. 1 is an isometric drawing of the present invention.

Air-tight artists' palette 10 of the present invention is illustrated in FIG. 1 by an isometric drawing.

The purpose of the palette 10 is to keep paint from drying and to keep it workable for an extended period of time.

As shown in FIG. 1, palette 10 includes a tray 1 upon which the air-tight covers 2 are assembled. Positioned in the rear of tray 1 and behind each color well 4 is the opening in which studs 5 (FIG. 3) for providing pivotal movement are mounted. These studs 5 (FIG. 3) are used for attaching slots 6 (FIG. 3) of cover 2 to the tray 1.

A. Tray

The tray 1 of palette 10 is illustrated in FIG. 1. In a preferred embodiment, the tray 1 includes multiple raised color wells 4. Each color well 4 is surrounded on the outside with a trough 8 which may contain a liquid compatible with the painting medium. When cover 2 is closed it seats in the trough 8. The liquid acts as a primary seal against air entering the color well chamber 4.

Figure 2:
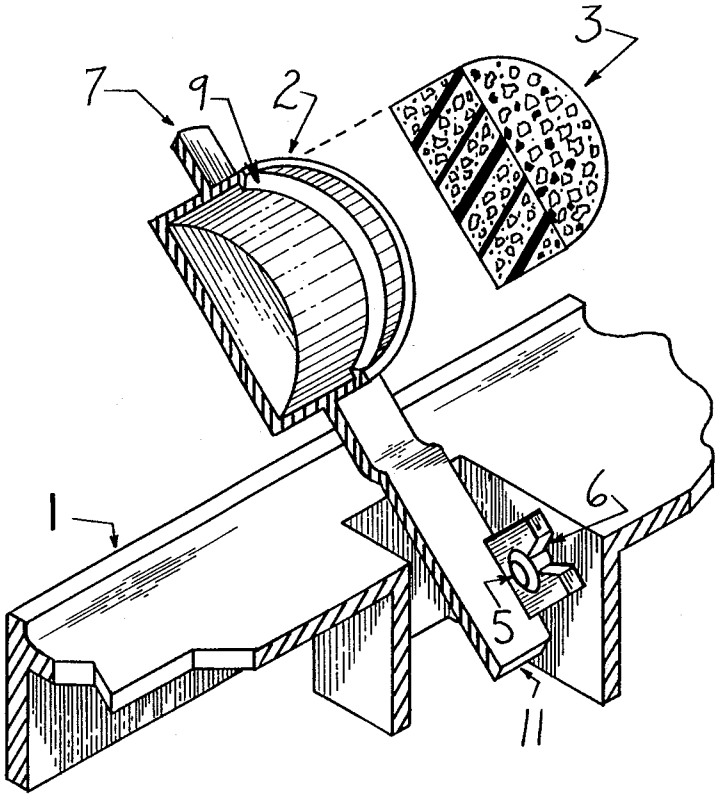
FIG. 2 is a sectional view of the cover and absorbent element and an exploded view of part of the tray showing the slotted rear extension of the cover mounted to the stud inside the opening.
Figure 3:
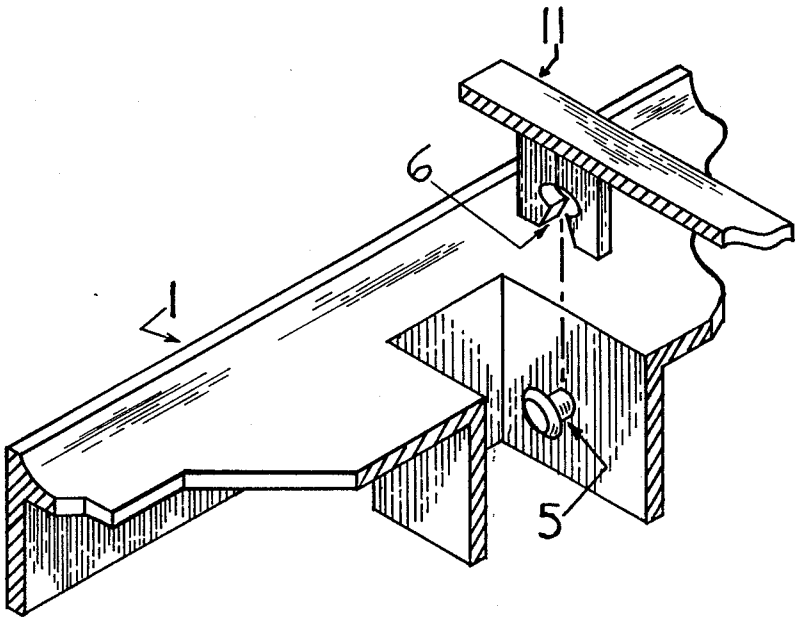
FIG. 3 is an exploded view of part of the tray showing the slot and stud relationship.

Positioned in the rear of the tray 1 and behind each well 4 is an opening in which studs 5 (FIG. 3) are mounted to provide pivotal movement. The opening and its pivotal studs 5 are best illustrated in FIG. 2 and FIG. 3.

B. Cover

The cover 2 of the palette 10 utilizes an absorbent element 3. When absorbent element 3 is moistened with liquid compatible with the painting medium and the cover 2 is closed the absorbent element 3 seats against the top rim of the well 4 and acts as a secondary air-tight seal in case a liquid is not used in the trough 8.

The absorbent element 3 is held in place by a lip 9 constructed inside the cover 2. The lip 9 is best illustrated in FIG. 2.

As shown in FIG. 2 the cover 2 includes an extension 11 at the rear in which slots 6 (FIG. 3) for pivotal movement are constructed. These slots 6 (FIG. 3) fit over studs 5 (FIG. 3) of tray 1 opening. Extension 11 is curved downward at a point where it enters the tray 1 as cover 2 is being closed. This enables the extension 11 of the cover 2 to fit flush against surface of the tray 1. Pivotal apparatus is best illustrated in FIG. 3.

Also shown in FIG. 1 is a tab 7 mounted on front of the cover 2. Tab 7 is used for ease in flipping cover 2 up and down on its pivotal axis.

To summarize, the present invention is an air-tight artists' palette which is efficient in storing and keeping paints suitable for working over an extended period of time.

Although the present invention has been described with reference to preferred embodiments, workers skilled in the art will recognize that changes may be made in form and detail without departing from the spirit and scope of the invention.

What is claimed is:

1. An air-tight artists' palette comprising a tray containing a plurality of wells for receiving a painting medium, an individual cover for each well located adjacent thereto, a means for receiving liquid cooperating with each cover for sealing each well, so that no air will contact the painting medium.

2. The palette of claim 1, wherein said means for receiving liquid comprises a trough surrounding each well, each trough being adapted to seat a cover in a sealing arrangement when said well is closed by said cover.

3. The palette of claim 1, wherein said means for receiving liquid includes an absorbent element adapted to be moistened and placed within said cover.

4. The palette of claim 1 including means for pivotably mounting said cover for engagement with said well comprising a stud and slot means.

5. The palette of claim 1 wherein said cover includes a tab for ease in opening and closing said cover.

* * * * *